US010724537B2

(12) United States Patent
Ahn et al.

(10) Patent No.: US 10,724,537 B2
(45) Date of Patent: Jul. 28, 2020

(54) BLADE STRUCTURE AND FAN AND GENERATOR HAVING SAME

(71) Applicant: Doosan Heavy Industries & Construction Co. LTD, Changwon-si, Gyeongsangnam-do (KR)

(72) Inventors: Dai Hyun Ahn, Changwon-si (KR); Sung Ha Kim, Changwon-si (KR); Sung Hoon Ha, Changwon-si (KR)

(73) Assignee: Doosan Heavy Industries & Construction Co. LTD., Changwon-si, Gyeongsangnam-do (KR)

( * ) Notice: Subject to any disclaimer, the term of this patent is extended or adjusted under 35 U.S.C. 154(b) by 157 days.

(21) Appl. No.: 15/981,805

(22) Filed: May 16, 2018

(65) Prior Publication Data

US 2018/0372115 A1 Dec. 27, 2018

(30) Foreign Application Priority Data

Jun. 26, 2017 (KR) ..... 10-2017-0080507

(51) Int. Cl.

| | |
|---|---|
| ***F04D 19/00*** | (2006.01) |
| ***F04D 29/38*** | (2006.01) |
| ***F04D 29/32*** | (2006.01) |
| ***F04D 29/52*** | (2006.01) |

(52) U.S. Cl.

CPC ..... *F04D 29/386* (2013.01); *F04D 19/002* (2013.01); *F04D 29/325* (2013.01); *F04D 29/522* (2013.01)

(58) Field of Classification Search

CPC .... F04D 19/002; F04D 29/325; F04D 29/386; F04D 29/522

See application file for complete search history.

(56) References Cited

U.S. PATENT DOCUMENTS

| | | | | |
|---|---|---|---|---|
| 4,334,828 | A | 6/1982 | Moffitt | |
| 5,167,489 | A * | 12/1992 | Wadia | B64C 11/18 415/182.1 |
| 6,287,078 | B1 * | 9/2001 | Min | F04D 29/326 416/189 |
| 6,315,521 | B1 * | 11/2001 | Hunt | F04D 29/326 416/192 |
| 6,328,533 | B1 * | 12/2001 | Decker | F01D 5/141 416/223 A |
| 6,368,061 | B1 * | 4/2002 | Capdevila | F04D 29/326 416/169 A |

(Continued)

FOREIGN PATENT DOCUMENTS

| | | | |
|---|---|---|---|
| JP | 2008545097 | A | 12/2008 |
| KR | 20050114975 | A | 12/2005 |

OTHER PUBLICATIONS

Korean Office Action.

*Primary Examiner* — Igor Kershteyn

(74) *Attorney, Agent, or Firm* — Foundation Law Group LLC; Kwang Jun Kim; J D Harriman

(57) ABSTRACT

The present disclosure relates to a blade structure and a fan and a generator having the same. In accordance with the present disclosure, there is the effect that can ultimately enhance efficiency of the generator by forming the sweep structure or the spline structure on the blade in the inflow direction side of fluid to reduce a low-speed region around the tip of the blade.

18 Claims, 14 Drawing Sheets
(4 of 14 Drawing Sheet(s) Filed in Color)

(56) References Cited

U.S. PATENT DOCUMENTS

| | | | | |
|---|---|---|---|---|
| 2011/0223024 | A1* | 9/2011 | Van Houten | F04D 29/386<br>416/189 |
| 2014/0245753 | A1* | 9/2014 | Lamb, Jr. | F01D 5/14<br>60/805 |
| 2016/0348700 | A1* | 12/2016 | Arai | F04D 19/002 |
| 2017/0298954 | A1* | 10/2017 | Qiu | F02K 3/06 |
| 2018/0073517 | A1* | 3/2018 | Pan | F02K 3/06 |

* cited by examiner

BLADE STRUCTURE AND FAN AND GENERATOR HAVING SAME

CROSS-REFERENCE TO RELATED APPLICATIONS

This application claims priority to Korean Patent Application No. 10-2017-0080507, filed on Jun. 26, 2017, the disclosure of which is incorporated herein by reference in its entirety.

BACKGROUND OF THE DISCLOSURE

Field of the Disclosure

The present disclosure relates to a blade structure and a fan and a generator having the same, and more particularly, to a blade structure and a fan and a generator having the same, which form a sweep structure or a spline structure on the blade in the inflow direction side of fluid to reduce a low-speed region around the lip of the blade.

Description of the Related Art

FIG. 1 illustrates a schematic diagram of a partial configuration of a general generator 1. The generator 1 drives a fan 3 to suck air through an inlet 2 of a suction pipe from the outside, and supplies the sucked air to a power generator 5A through an outlet 4. Herein, the power generator 5A can be a device that uses the air as an operation medium, such as a gas turbine.

FIG. 2 illustrates the structure of a blade 7 of the conventional fan 3, and the structure of the conventional blade 7 is the structure that has a plurality of blades 7 almost vertically located to be spaced at a predetermined interval along the circumferential direction of a hub 6 of the fan 3.

In the conventional fan 3, since the cross-section of the blade 7 is overlapped along the circumference of the hub 6 without changing the angle in the radius direction, the shape of the velocity triangle is the same in any radius.

However, in the structure of the conventional blade 7, since the length of the blade is present between a root portion 9 connected to the hub 6 of the fan 3 and a tip portion 5B adjacent to an inner surface of the suction pipe, a difference of line velocities occurs between the root portion 9 and the tip portion 5B.

This cause a difference of flow rates along the length of the blade 7 to occur a low-speed region at the tip portion 5B, such that there is the problem that eventually causes the reduction to performance and efficiency of the fan 3.

RELATED ART DOCUMENT

Patent Document (Patent Document 1) European Patent No. 1930554 A2

SUMMARY OF THE DISCLOSURE

The present disclosure is proposed for solving the above problem, and the object of the present disclosure is to provide a blade structure and a fan and a generator having the same, which form a sweep structure or a spline structure on the blade in the inflow direction side of fluid to reduce a low-speed region around the tip of the blade.

The present disclosure for achieving the object relates to a blade structure, and can include a body portion of a blade located in plural spaced at a predetermined interval along the circumferential direction of a hub of a fan, and including a root portion connected to the hub and a tip portion forming an outside end portion thereof; a leading edge portion formed at the inflow direction side of fluid-on the body portion; a trailing edge portion formed at the outflow direction side of fluid on the body portion; and a sweep portion formed in a straight line on at least any one of the leading edge portion or the trailing edge portion in order to reduce a fluid low-speed region at the tip portion compared to the root portion.

In addition, in an embodiment of the present disclosure, the sweep portion can include a first sweep portion formed at the leading edge portion of the body portion, and have forward sweep formed in the inflow direction side of fluid.

In addition, in an embodiment of the present disclosure, the first sweep portion can be formed at the outside portion based on the radial direction of the leading edge portion.

In addition, in an embodiment of the present disclosure, the leading edge portion can be divided into a first leading portion and a second leading portion based on the longitudinal direction thereof, and the first sweep portion can be formed on the first leading portion and the second leading portion at different angles.

In addition, in an embodiment of the present disclosure, the sweep portion can include a second sweep portion formed at the trailing edge portion of the body portion, and have a forward sweep formed in the inflow direction side of fluid.

In addition, in an embodiment of the present disclosure, the second sweep portion can be formed at the outside portion based on the radial direction of the trailing edge portion.

In addition, in an embodiment of the present disclosure, the trailing edge portion can be divided into: a first terminal portion and a second terminal portion based on the longitudinal direction thereof, and the second sweep portion can be formed on tire first terminal portion and the second terminal portion at different angles.

In addition, in an embodiment of the present disclosure, the sweep portion can include a first sweep portion formed at the leading edge portion, and a second sweep portion formed at the trailing edge portion; and the first sweep portion and the second sweep portion can have a forward sweep formed at different angles.

In addition, in an embodiment of the present disclosure, an angle of the first sweep portion can be more acute than an angle of the second sweep portion.

In addition, in an embodiment of the present disclosure, a blade structure can include a body portion of a blade located in plural spaced at a predetermined interval along the circumferential direction of a hub of a fan, and including a root portion connected to the hub and a tip portion forming an outside end portion thereof; a leading edge portion formed at the inflow direction side of fluid on the body portion; a trailing edge portion formed at the outflow direction side of fluid on the body portion; and a spline portion formed in a curve on at least any one of the leading edge portion or the trailing edge portion in order to reduce a fluid low-speed region at the tip portion compared to the root portion.

In addition, in an embodiment of the present disclosure, the spline portion can include a first spline portion formed at the leading edge portion of the body portion, and can be formed to have a predetermined curvature in the inflow direction side of fluid.

In addition, in an embodiment of the present disclosure, the first spline portion can be formed in a 25~100% region based on the root portion of the body portion along the radial direction of the leading edge portion.

In addition, in an embodiment of the present disclosure, the first spline portion can be formed in a 50~100% region based on the root portion of the body portion along the radial direction of the leading edge portion.

In addition, in an embodiment of the pre sent disclosure, the first spline portion can be formed in a 75~100% region based on the root portion of the body portion along the radial direction of the leading edge portion.

In addition, in an embodiment of the present disclosure, the spline portion can include a second spline portion formed at the trailing edge portion of the body portion, and can be formed to have a predetermined curvature in the inflow direction side of fluid.

In addition, in an embodiment of the present disclosure, the second spline portion can be formed in a 25~100% region based on the root portion of the body portion along the radial direction of the trailing edge portion.

In addition, in an embodiment of the present disclosure, the second spline portion can be formed in a 50~400% region based on the root portion of the body portion along the radial direction of the trailing edge portion.

In addition, in an embodiment of the present disclosure, the second spline portion can be formed in a 75~100% region based on the root portion of the body portion along the radial direction of the toiling edge portion.

In addition, in an embodiment of the present disclosure, the spline portion can include a first spline portion formed at the leading edge portion, and a second spline portion formed at the trailing edge portion; and the first spline portion and the second spline portion can be inclined toward the inflow direction side of fluid at different curvatures.

A fan and a generator of the present disclosure can include a suction pipe into which external fluid is flowed, a power generator connected with the suction pipe and producing power using the fluid flowed from the suction pipe, and a fan interposed between the suction pipe and the power generator, and sucking the fluid from the suction pipe and delivering it to the power generator; and the fan can include a hub connected to a rotation shaft of a driving device; and a blade located in plural spaced at a predetermined interval along the circumferential direction of the hub, and including the blade structure.

In accordance with the present disclosure, by forming the sweep structure or the spline structure on the blade in the inflow direction side of fluid to reduce a low-speed region around the tip of the blade, it can be expected to ultimately enhance efficiency of the generator.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DESCRIPTION OF SPECIFIC EMBODIMENTS

Hereinafter, an embodiment of a blade structure and a fan and a generator having the same in accordance with the present disclosure will be described in detail with reference to the accompanying drawings.

Figure 3:
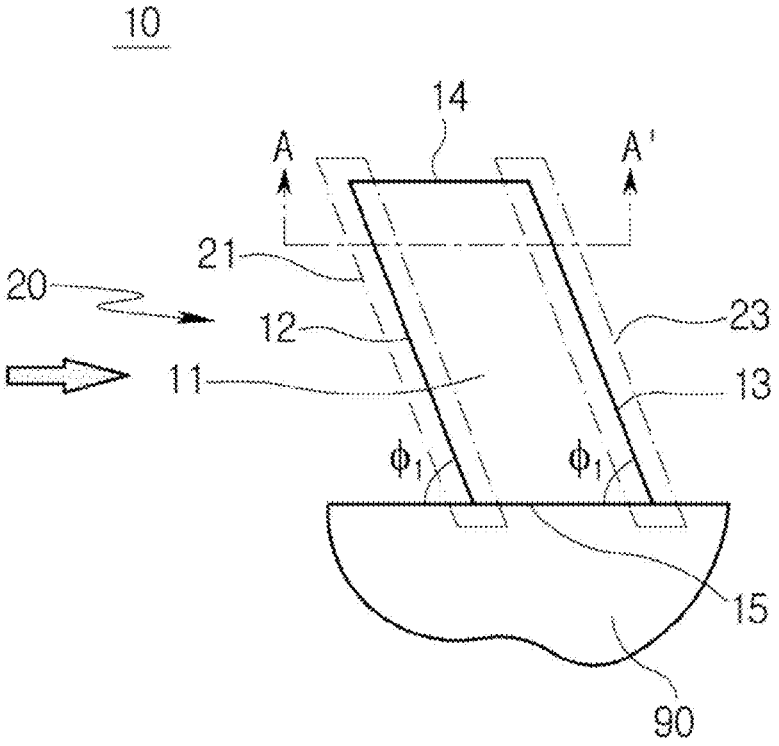
FIG. 3 is a diagram illustrating one aspect of an embodiment of a blade structure of the present disclosure.
Figure 4:
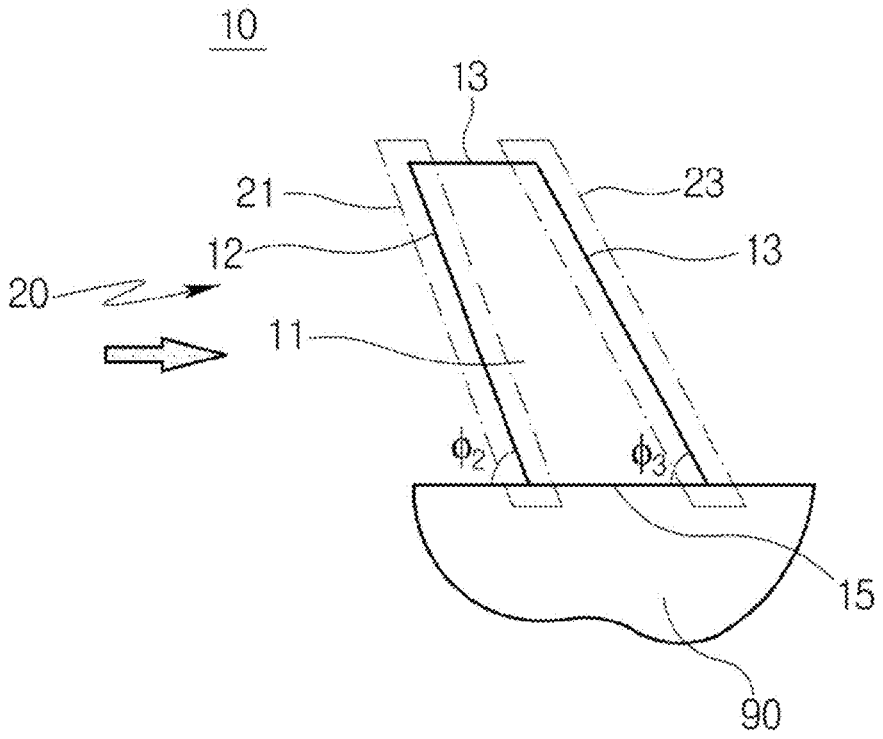
FIG. 4 is a diagram illustrating another aspect of ant embodiment of the present disclosure.
Figure 5:
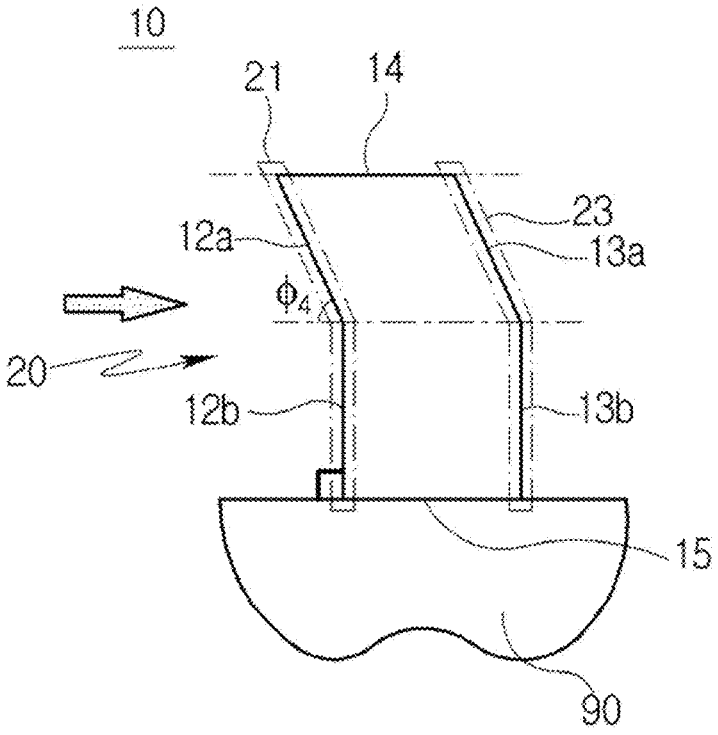
FIG. 5 is a diagram illustrating yet another aspect of an embodiment of the present disclosure.
Figure 6:
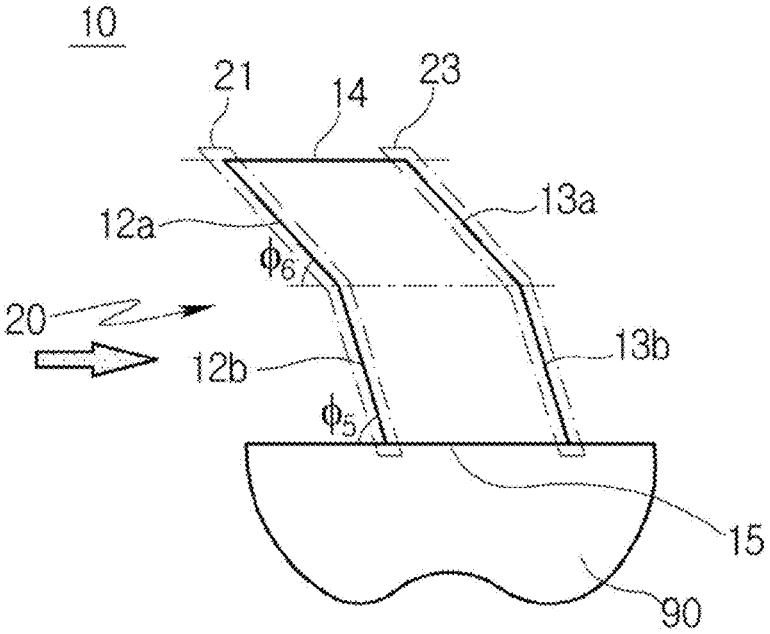
FIG. 6 is a diagram illustrating yet still another aspect of an embodiment of the present disclosure.

FIG. 3 is a diagram illustrating an embodiment of a blade structure of the present disclosure, FIG. 4 is a diagram illustrating another aspect of an embodiment of the present disclosure, FIG. 5 is a diagram illustrating yet another aspect of an embodiment of the present disclosure, and FIG. 6 is a diagram illustrating yet still another aspect of an embodiment of the present disclosure.

Referring to FIGS. 3 to 6, an embodiment of the structure of a blade 10 of the present disclosure can be configured to include a body portion 11, a leading edge portion 12, a trailing edge portion 13, and a sweep portion 20.

Figure 14:
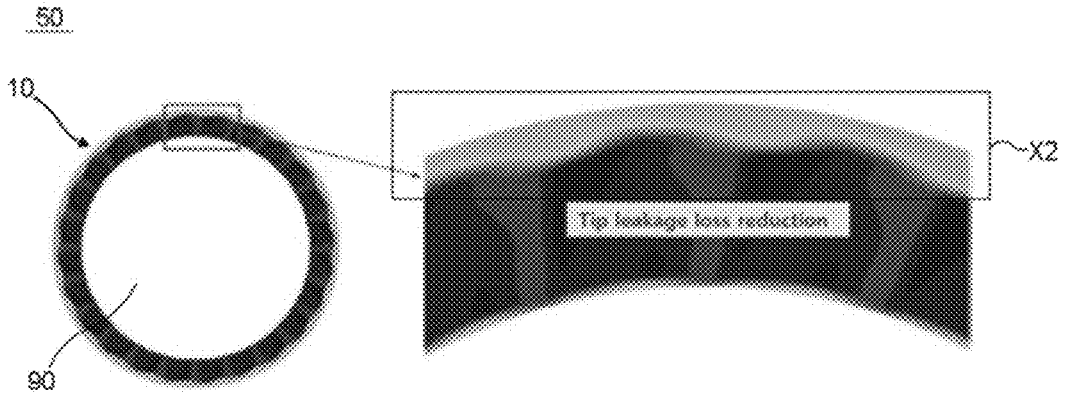
FIG. 14 is a diagram illustrating the low-speed region by the blade structure of the present disclosure at a different angle.

The body portion 11 forming the blade 10 can be located in plural spaced at a predetermined interval along the circumferential direction of a hub 90 of a fan 50 (referring to FIG. 14). In an embodiment of the present disclosure, 24 blades 10 can be located along the circumferential direction of the hub 90 at 15 degree intervals, but not necessarily limited thereto.

And, the body portion 11 can be composed of a root portion 15 connected to the hub 90 and a tip portion 14 forming an outside end portion of the body portion 11.

The leading edge portion 12 can be formed at the inflow direction side of fluid on the body portion 11, and the trailing edge portion 13 can be formed at the outflow direction side of fluid on the body portion 11.

In addition, the sweep portion 20 can be formed in a straight line on the body portion 11 in order to reduce a fluid low-speed region at the tip portion 14 compared to the root portion 15.

Specifically, the sweep portion 20 can have a first sweep portion 21 formed at the leading edge portion 12 formed on the body portion 11 and a second sweep portion 23 formed at the trailing edge portion 13, respectively, and have a forward sweep formed in the inflow direction side of fluid.

That is, the sweep portion 20 means the forward sweep shape formed in the inflow direction side of fluid on the leading edge portion 12 and the trailing edge portion 13.

FIG. 3 illustrates one aspect of an embodiment of the present disclosure. In FIG. 3, as it goes from the root portion 15 of the body portion 11 to the tip portion 14 thereof, the sweep portion 20 is formed on the entire of the leading edge portion 12 and the trailing edge portion 13.

In the aspect illustrated in FIG. 3, a sweep angle (Φ1) of the first sweep portion 21 formed on the leading edge portion 12 and a sweep angle (Φ1) of the second sweep portion 23 formed on the trailing edge portion 13 are the same.

In an embodiment of the present disclosure, the sweep angle can be 20 degrees. The effects thereby are illustrated in FIGS. 11 to 14 as the experimental results.

Figure 2:
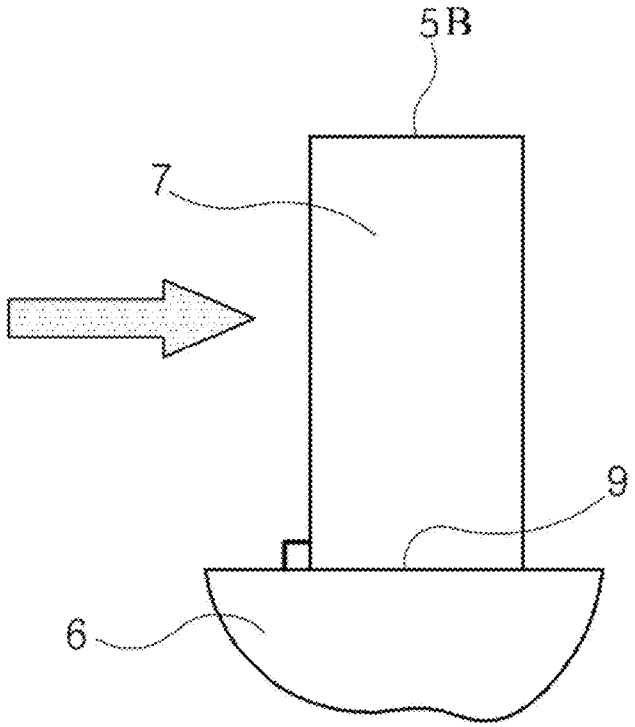
FIG. 2 (RELATED ART)
FIG. 2 is a diagram illustrating a blade structure of a conventional fan.
Figure 11:
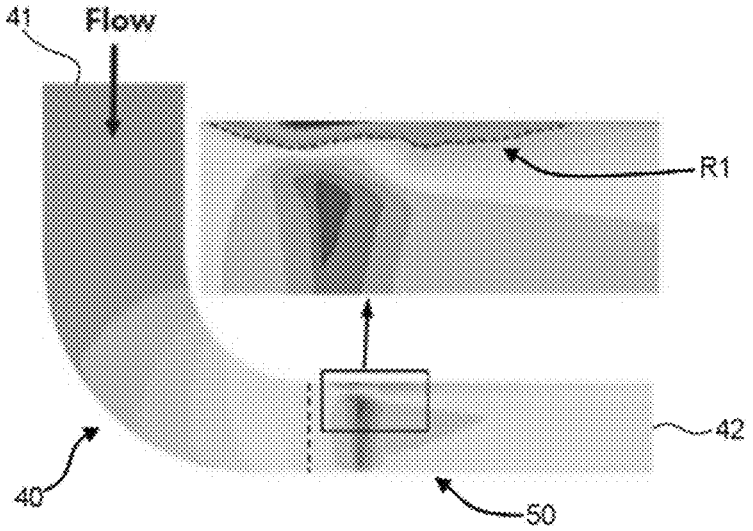
FIG. 11 (RELATED ART)
FIG. 11 is a diagram illustrating a low-speed region by the conventional blade structure.
Figure 12:
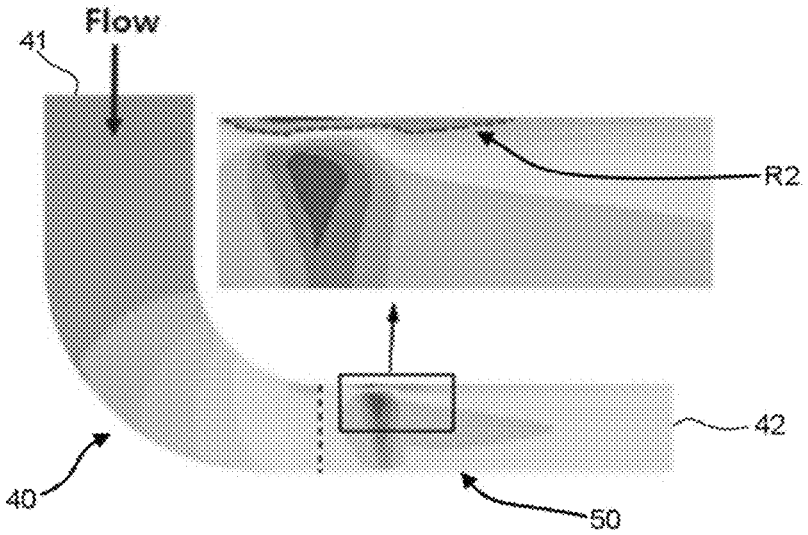
FIG. 12 is a diagram illustrating a low-speed region by the blade structure of the present disclosure.

Firstly, referring to FIGS. 11 and 12, FIG. 11 illustrates a low-speed region (R1) inside a suction pipe 40 by the operation of the fan on which a general blade (referring to FIG. 2) not forming the conventional sweep portion 20 is mounted. And, FIG. 12 illustrates a low-speed region (R2) inside the suction pipe 40 by the operation of the fan 50 (referring to FIG. 3) on which the blade 10 of the present disclosure forming the sweep portion 20 (referring to FIG. 3) is mounted. The air is flowed through an inlet 41, and flows through the fan 50 and an outlet 42 to a power generator.

Comparing the low-speed regions in the enlarged diagrams of FIGS. 11 and 12, it can be seen that R2 is reduced compared to R1 through the experimental results.

A difference of the effects such as the experimental results is caused by the following technical basis.

In the conventional fan, since the cross-section of the blade is located to be overlapped without changing the angle in the radius direction, the shape of velocity triangle is the same in any radius.

However, since the length of the blade is present in real, a difference of line velocities between the root portion 15 of the blade and the tip portion 14 thereof occurs. Accordingly, a relative flow angle of the air flowed into the inlet side of the fan 50 is changed depending upon the radius of the fan 50.

Under this operation circumstance, applying the sweep design to all or part of the flow region of the air from the root portion 15 of the blade to the tip portion 14 thereof, various relative flows occur at each location compared to the shape of the conventional blade, and this particularly operates in the direction of reducing the low-speed region at the tip portion 14 of the blade.

Consequently, in accordance with the experimental results, the low-speed region (R2) illustrated in the enlarged diagram of FIG. 12, which is reduced compared to the low-speed region (R1) illustrated in the enlarged diagram of FIG. 11, is formed.

The effect of reducing the low-speed region at the tip portion 14 of the blade as described above reduces leakage loss to reduce total pressure loss at the rear end of the fan 50. This ultimately enhances performance and efficiency of the fan 50.

Figure 13:
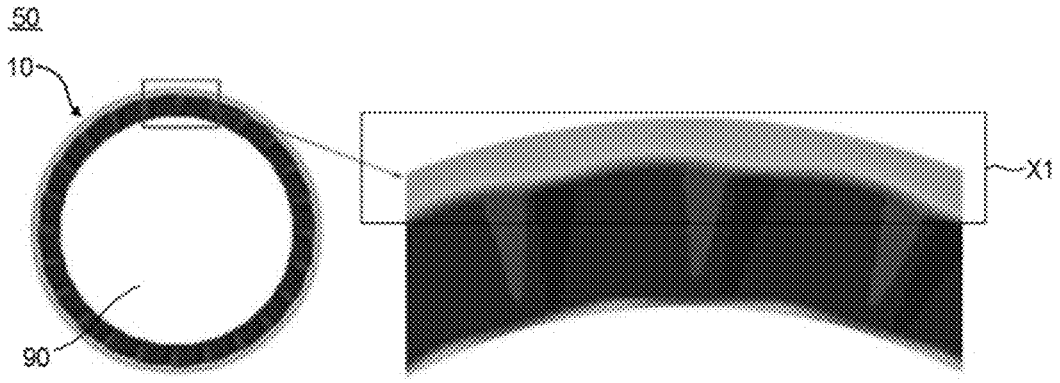
FIG. 13 (RELATED ART)
FIG. 13 is a diagram illustrating the low-speed region by the conventional blade structure at a different angle.

Next, referring to FIGS. 13 and 14, FIG. 13 illustrates the low-speed region (X1) inside the suction pipe 40 by the operation of the fan, on which a general blade (referring to FIG. 2) not forming the conventional sweep portion 20 is mounted, at an angle viewed at the front of the fan 50. And, FIG. 14 illustrates the low-speed region (X2) inside the suction pipe 40 by the operation of the fan 50, on which the blade 10 of the present disclosure forming the sweep portion 20 is mounted, at an angle viewed at the front of the fan 50.

Comparing the low-speed regions in the enlarged diagrams in FIGS. 13 and 14, it can be seen that X2 is reduced compared to X1 through the experimental results.

In the conventional fan illustrated in FIG. 13, it can be seen that the low-speed region formed around the tip portion 14 of the blade is formed to be relatively thick along the radial direction of the fan 50. In comparison, in the fan 50 of the present disclosure illustrated in FIG. 14, it can be seen that as the sweep portion 20 is applied to the leading edge portion 12 and the trailing edge portion 13, the low-speed region (X2) that is formed around the tip portion 14 of the blade 10 and tanned in the radial direction of the fan 50 is relatively reduced rather than the low-speed region (X1) illustrated in FIG. 13.

This is, as described above, because the sweep angle is formed in the inflow direction of the air to occur the relative flow at the root portion 15 of the blade 10 and the tip portion 14 thereof, thus enhancing the velocity at the tip portion 14 compared to the convention.

Meanwhile, FIG. 4 illustrates another aspect of an embodiment of the present disclosure. In FIG. 4, the sweep portion 20 can be formed at the leading edge portion 12 and the trailing edge portion 13 at different angles.

A sweep angle (Φ2) of the first sweep portion 21 at the leading edge portion 12 can be more acute than a sweep angle (Φ3) of the second sweep portion 23 at the trailing edge portion 13 and also have a forward sweep formed in the inflow direction side of fluid, thus achieving the effect of reducing the low-speed region at the tip portion 14 of the blade 10.

Herein, the steep angles (Φ2, Φ3) can be set at appropriate angles that can achieve the optimal effect of reducing the low-speed region through the experimental results.

And, FIG. 5 illustrates yet another aspect of an embodiment of the present disclosure. In FIG. 5, the sweep portion 20 can be formed at an outside portion based on the radial direction of the leading edge portion 12 and the trailing edge portion 13.

Specifically, the leading edge portion 12 can be divided into a first leading portion 12*a* and a second leading portion 12*b* based on the longitudinal direction thereof, and the first sweep portion 21 can be formed only at the first leading portion 12*a*. That is, a sweep angle (Φ4) of the first sweep portion 21 can be formed on the first leading portion 12*a*, and the second leading portion 12*b* can be vertically formed on the root portion 15 of the blade 10.

In addition, the trailing edge portion 13 can be divided into a first terminal portion 13*a* and a second terminal portion 13*b* based on the longitudinal direction thereof, and the second sweep portion 23 can be formed only at the first terminal portion 13*a*. That is, the sweep angle (Φ4) of the second sweep portion 23 can be formed on the first terminal portion 13*a*, and the second terminal portion 13*b* can be vertically formed on the root portion 15 of the blade 10.

Herein, the region ranges in the longitudinal directions of the first leading portion 12*a* and the second leading portion 12*b*, and the first terminal portion 13*a* and the second terminal portion 13*b* can be appropriately selected through the experimental results in order to achieve the optimal effect of reducing the low-speed region.

Even in this case, the sweep portion 20 can have a forward sweep formed in the inflow direction side of fluid, thus achieving the effect of reducing the low-speed region at the tip portion 14 of the blade 10.

Next, FIG. 6 illustrates yet still another aspect of an embodiment of the present disclosure. The sweep portion 20 can be formed at the outside portion based on the radial directions of the leading edge portion 12 and the trailing edge portion 13.

Specifically, the leading edge portion 12 can be divided into the first leading portion 12*a* and the second leading portion 12*b* based on the longitudinal direction thereof, and the first sweep portion 21 can be formed at the first leading portion 12*a* and the second leading portion 12*b* at different angles. That is, a sweep angle (Φ6) of the first sweep portion 21 can be formed on the first leading portion 12*a*, and the second leading portion 12*b* can be formed on the root portion 15 of the blade 10 at a sweep angle (Φ5).

In addition, the trailing edge portion 13 can be divided into the first terminal portion 13*a* and the second terminal portion 13*b* based on the longitudinal direction thereof, and the second sweep portion 23 can be formed at the first terminal portion 13*a* and the second terminal portion 13*b* at different angles. That is, the sweep angle (Φ6) of the second sweep portion 23 can be formed on the first terminal portion 13*a*, and the second terminal portion 13*b* can be formed on the root portion 15 of the blade 10 at the sweep angle (Φ5).

Herein, the region ranges in the longitudinal directions of the first leading portion 12*a* and the second leading portion 12*b*, and the first terminal portion 13*a* and the second terminal portion 13*b* can be appropriately selected through the experimental results in order to achieve the optimal effect of reducing the low-speed region.

Even in this case, the sweep portion 20 can have a forward sweep formed in the inflow direction side of fluid, thus achieving the effect of reducing the low-speed region at the tip portion 14 of the blade 10.

The sweep angles of an embodiment of the present disclosure can be set at different angles through the experimental results as the object of achieving the effect of reducing the low-speed region at the tip portion 14 of the blade 10, and the comparison experiments will be described with reference to FIGS. 15 and 16.

Figure 7:
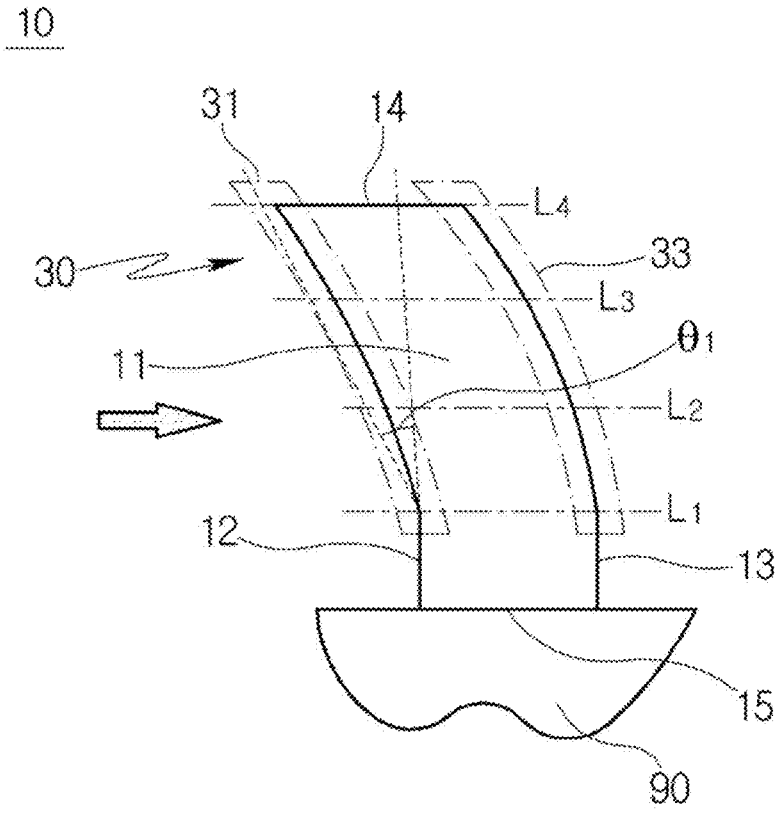
FIG. 7 is a diagram illustrating one aspect of an embodiment of the blade structure of the present disclosure.
Figure 8:
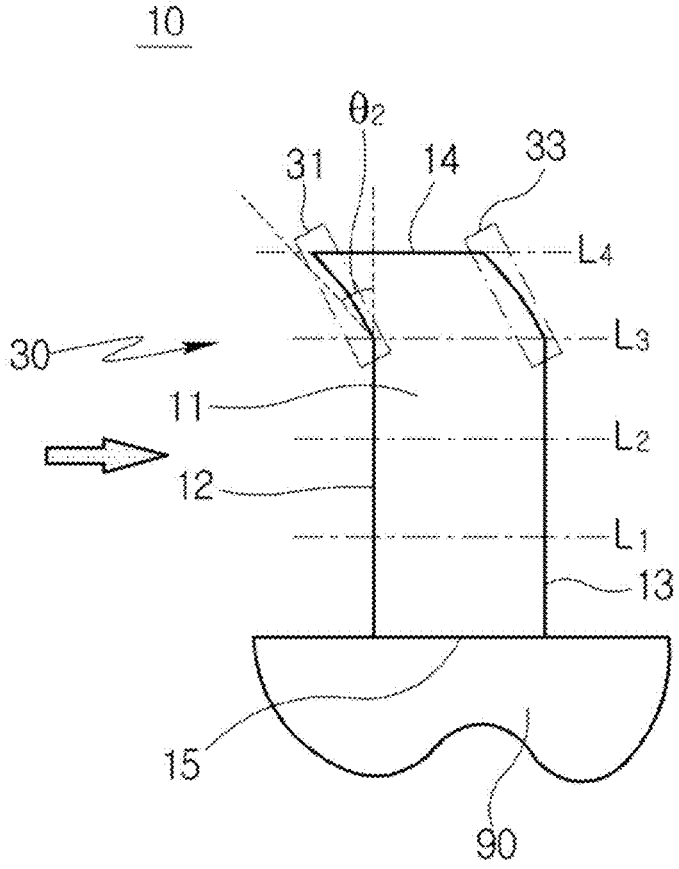
FIG. 8 is a diagram illustrating another aspect of an embodiment of the present disclosure.
Figure 9:
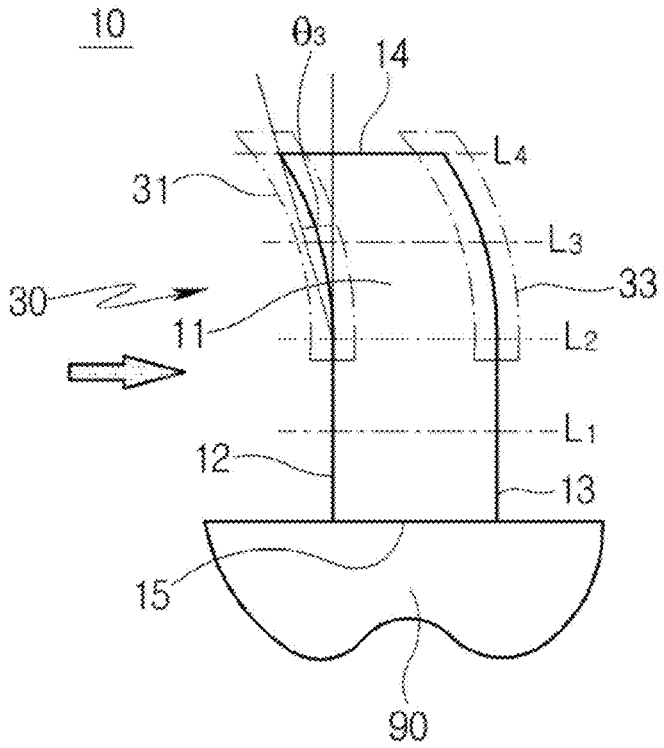
FIG. 9 is a diagram illustrating yet another aspect of an embodiment of the present disclosure.
Figure 10:
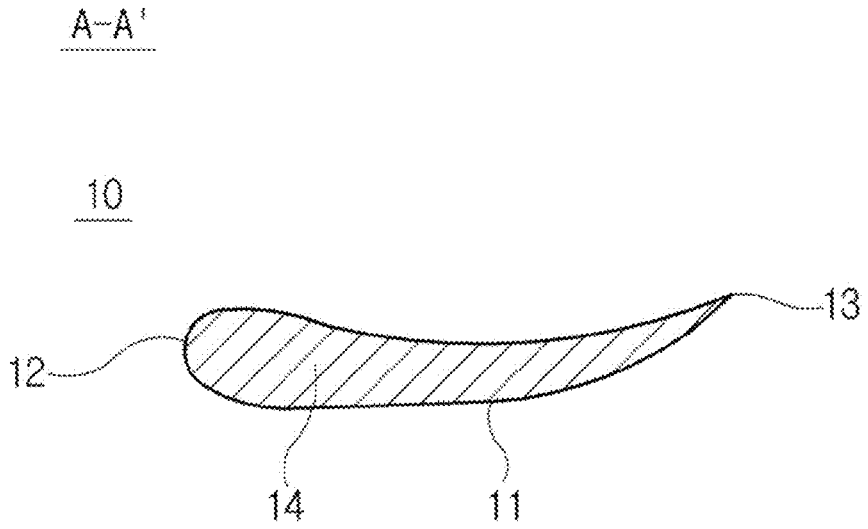
FIG. 10 is a diagram illustrating the cross-section taken along line A-A' in FIG. 3.

FIG. 7 is a diagram illustrating an embodiment of the blade structure of the present disclosure, FIG. 8 is a diagram illustrating another aspect of an embodiment of the present disclosure, and FIG. 9 is a diagram illustrating yet another aspect of an embodiment of the present disclosure.

Referring to FIGS. 7 to 9, an embodiment of the structure of the blade 10 of the present disclosure can be configured to include the body portion 11, the leading edge portion 12, the trailing edge portion 13, and a spline portion 30.

The body portion 11 forming the blade 10 can be located in plural spaced at a predetermined interval along the circumferential direction of the hub 90 of the fan 50 (referring to FIG. 14). In an embodiment of the present disclosure, 24 blades 10 can be located along the circumferential direction of the hub 90 at 15 degree intervals, but not necessarily limited thereto.

And, the body portion 11 can be composed of the root portion 15 connected to the hub 90, and the tip portion 14 forming the outside end portion of the body portion 11.

The leading edge portion 12 can be formed at the inflow direction side of fluid on the body portion 11, and the trailing edge portion 13 can be formed at the outflow direction side of fluid on the body portion 11.

In addition, the spline portion 30 can be formed in a curve on the body portion 11 in order to reduce a fluid low-speed region at the tip portion 14 compared to the root portion 15.

Specifically, the sweep portion 20 can have a first spline portion 31 formed at the leading edge portion 12 formed on the body portion 11, and a second spline portion 33 formed at the trailing edge portion 13, respectively, and have a forward sweep formed in the inflow direction side of fluid.

FIG. 7 illustrates one aspect of an embodiment of the present disclosure. In an embodiment of the present disclosure, the spline portion 30 can include the first spline portion 31 formed at the leading edge portion 12 of the body portion 11, and the second spline portion 33 formed at the trailing edge portion 13 thereof, and the first and second spline portions 31, 33 can be formed to have a predetermined curvature (θ1) in the inflow direction side of fluid.

In one aspect, the spline portion 30 can be formed in a 25~100% region based on the root portion 15 of the body portion 11 along the radial directions of the leading edge portion 12 and the trailing edge portion 13.

Herein, based on the root portion 15 of the blade 10, L1 is a 25% point, L2 is a 50% point, L3 is a 75% point, and L4, as a 100% point, becomes the tip portion 14 of the blade 10.

The region in which the spline portion 30 is not formed at the body portion 11 of the blade 10 is the 25% point at the root portion 15. This is the region formed to be perpendicular to the outer circumferential surface of the hub 90.

Even in this case, the spline portion 30 can have a forward sweep formed in the inflow direction side of fluid, thus achieving the effect of reducing the low-speed region at the tip portion 14 of the blade 10.

Specifically, in the conventional fan, since the cross-section of the blade is located to be overlapped without changing the curvature in the radius direction, the shape of the velocity triangle is the same in any radius.

However, since the length of the blade, is present in real, a difference of the line velocities between the root portion 15 of the blade and the tip portion 14 thereof occurs. Accordingly, a relative flow angle of the air flowed into the inlet side of the fan 50 is changed depending upon the radius of the fan 50.

Under this operation circumstance, applying the spline-design to all or part of the flow region of the air from the root portion 15 of the blade to the tip portion 14 thereof, various relative flows occur at each location compared to the shape of the conventional blade, and this particularly operates in the direction of reducing the low-speed region at the tip portion 14 of the blade.

The effect of reducing the low-speed region at the lip portion 14 of the blade as described above reduces leakage loss, and thus reduces total pressure loss at the rear end of the fan 50. This ultimately enhances performance and efficiency of the fan 50.

And, FIG. 8 illustrates another aspect of an embodiment of the present disclosure. Even in another aspect, the spline portion 30 can include the first spline portion 31 formed at the leading edge portion 12 of the body portion 11 and the second spline portion 33 formed at the trailing edge portion 13 thereof, and the first and second spline portions 31, 33 can be formed to have a predetermined curvature (θ2) in the inflow direction side of fluid.

However, in another aspect, the spline portion 30 can be formed in the 75~100% region based on the root portion 15 of the body portion 11 along the radial directions of the leading edge portion 12 and the trailing edge portion 13.

The region in which the spline portion 30 is not formed at the body portion 11 of the blade 10 is the 75% point at the root portion 15. This is the region formed to be perpendicular to the outer circumferential surface of the hub 90. The spline portion 30 can have a forward sweep formed in the inflow direction side of fluid, thus achieving the effect of reducing the low-speed region at the tip portion 14 of the blade 10.

The comparative experiments on the fact that the spline portion 30 is formed to have a difference from the root portion 15 of the blade 10 to the tip portion 14 thereof will be described below with reference to FIGS. 15 and 16.

Next, FIG. 9 illustrates yet another aspect of an embodiment of the present disclosure. Even in yet another aspect, the spline portion 30 can include the first spline portion 31 formed at the leading edge portion 12 of the body portion 11 and the second spline portion 33 formed at the trailing edge portion 13 thereof, and the first and second spline portions 31, 33 can be formed to have a predetermined curvature (θ3) in the inflow direction side of fluid.

In yet another aspect, the spline portion 30 can be formed in the 50~100% region based on the root portion 15 of the body portion 11 along the radial directions of the leading edge portion 12 and the trailing edge portion 13.

The region in which the spline portion 30 is not formed at the body portion 11 of the blade 10 is the 50% point at the root portion 15. This is the region formed to be perpendicular to the outer circumferential surface of the hub 90. The spline portion 30 can have a forward sweep formed in the inflow direction side of fluid, thus achieving the effect of reducing the low-speed region at the tip portion 14 of the blade 10.

Herein, although not illustrated in a drawing, the spline portion 30 can have a difference between the curvature of the first spline portion 31 formed at the leading edge portion 12 and the curvature of the second spline portion 33 formed at the trailing edge portion 13. This can be identically applied in the ranges of 25~100%, 50~100%, and 75~100% formed in the L1~L4 regions illustrated in FIGS. 7 to 9.

And, referring to the aspect illustrated in FIG. 4, the curvature of the first spline portion 31 can be more acute than the curvature of the second spline portion 33 and can be also inclined toward the inflow direction side of fluid, thus achieving the effect of reducing the low-speed region at the tip portion 14 of the blade 10.

Herein, the curvature value can be set at an appropriate angle that can achieve the optimal effect of reducing the low-speed region through the experimental results.

Figure 15:
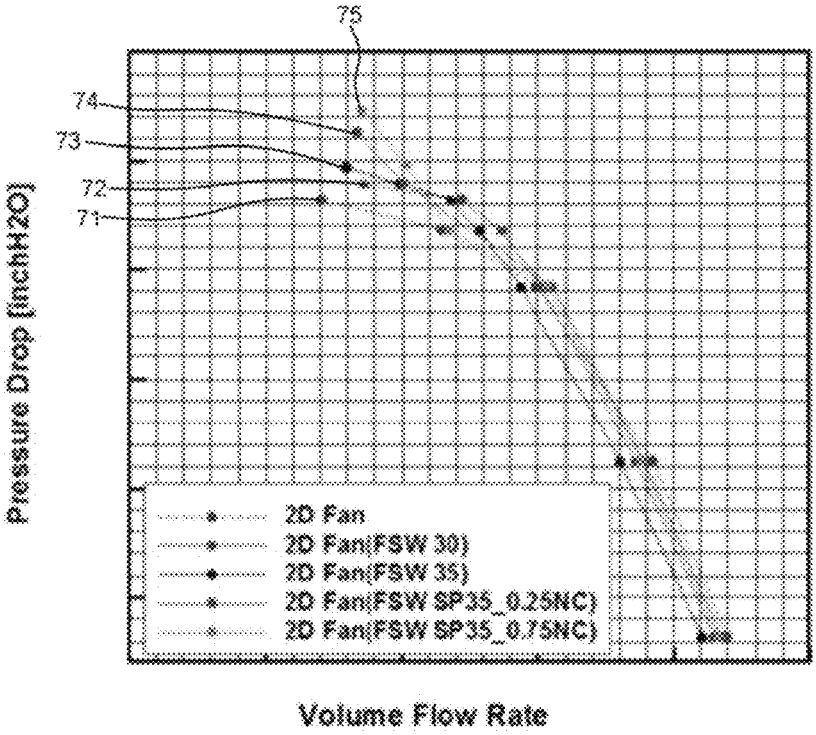
FIG. 15 is a diagram illustrating comparison of pressure drop in accordance with the convention and an embodiment of the present disclosure.
Figure 16:
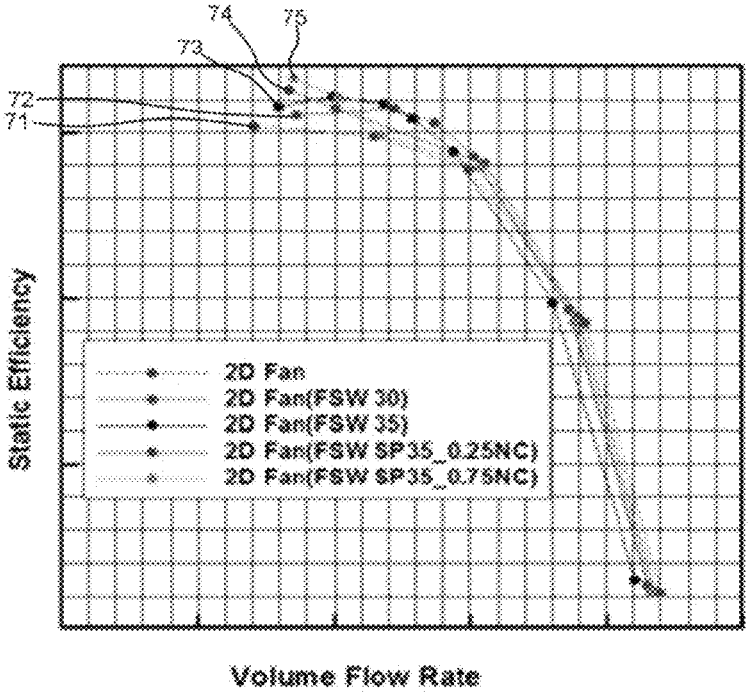
FIG. 16 is a diagram illustrating comparison of constant-pressure efficiency in accordance with the convention and an embodiment of the present disclosure.

Meanwhile, FIGS. 15 and 16 illustrate the comparative experiments on the conventional blade structure, versus a model forming the sweep angles (30°, 35°) in the first aspect of an embodiment of the present disclosure, and versus the model applying the spline (θ1, θ2=35°) in the first and second aspects of an embodiment of the present disclosure, respectively.

Hereinafter, FSW means Forward-Sweep angle, SP means SPline, and NC means No Charge.

Herein, 2D Fan 71 (blue) means the blade structure of the conventional fan.

And, 2D Fan 72 (FSW 30) (purple) is the aspect to which the sweep angle 30° is applied in the first aspect of an embodiment of the present disclosure, and 2D Fan 73 (FSW 35) (black) means the aspect to which the sweep angle 35° is applied in the first aspect of an embodiment of the present disclosure.

In addition, 2D Fan 74 (FSW SP 35_0.25 NC) (red) means the aspect to which the spline angle 35° is applied and a non-spline portion 30 (no charge) is applied till the 25% region in the first aspect of an embodiment of the present disclosure, and 2D Fan 75 (FSW SP 35_0.75 NC) (green) means the aspect to which the spline angle 35° is applied and the non-spline portion 30 (no charge) is applied till the 75% region in the second aspect of an embodiment of the present disclosure.

Firstly, referring to FIG. 15, a volume flow rate (CFM (cubic feet per minute)) versus pressure drop (InchH2O) at the inlet side of the air and the outlet side of the air based on the fan 50 are illustrated by comparison depending upon each aspect.

As can be seen in FIG. 15, the fans 72 (2D Fan (FSW 30)) and 73 (2D Fan (FSW 35)) to which the sweep angle is applied was relatively larger in pressure drop in the region where the volume flow rate is low compared to the fan 71 (2D Fan) having the conventional blade structure. The relatively high pressure drop means that the flow rate is relatively high in Bernoulli's principle. That is, this means the reduction in the low-speed region at the periphery of the fan.

In addition, the fans 74 (2D Fan (FSW SP 35_0.25 NC) and 75 (2D Fan (FSW SP 35_0.75 NC)) to which the spline structure is applied was relatively larger in pressure drop in the region where the volume How rate is low compared to the fan 71 (2D Fan) having the conventional blade structure. This also means the reduction in the low-speed region at the periphery of the fan.

However, in the region where the volume flow rate is high, there was no significant difference in the pressure drop.

In supplying the air to the generator through the experimental results, it can be seen that when supplying a relatively small flow amount, the structure of the blade 10 of the present disclosure reduces the low-speed region to occur large effect.

And, in the region where the volume flow rate is high, it can be seen that there is no significant difference in the pressure drop, such that there is no difference in performance from the conventional blade structure.

That is, in applying the structure of the blade 10 of the present disclosure, it means that since the low-speed region is effectively reduced under the circumstance that the volume How rate is low compared to the conventional blade structure and performance thereof is maintained under the circumstance that the volume flow rate is high, it is preferable to apply the present disclosure to the suction pipe 40 of the generator.

Next, referring to FIG. 16, a volume flow rate (CFM) versus static efficiency (unit %) at the inlet side of the air and the outlet side of the air based on the fan are illustrated by comparison depending upon each aspect.

As can be seen in FIG. 16, the fans 72 (2D Fan (FSW 30)) and 73 (2D Fan (FSW 35)) to which the sweep angle is applied was relatively larger in the static efficiency in the region where the volume flow fate is low compared to the fan 71 (2D Fan) having the conventional blade structure.

The relatively high static efficiency, as illustrated in FIG. 16, means that the pressure drop is relatively high and the flow rate is relatively high, and thereby the low-speed region at the periphery of the fan is reduced, thus enhancing efficiency of the fan.

In addition, the fans 74 (2D Fan (FSW SP 35_0.25 NC)) and 73 (2D Fan (FSW SP 35_0.75 NC)) to which the spline structure is applied was relatively larger in the static efficiency in the region where the volume flow rate is low compared to the fan 71 (2D Fan) having the conventional blade structure. This also means that the low-speed region at the periphery of the fan is reduced, thus enhancing efficiency of the fan.

However, in the region where the volume flow rate is high, there was no significant difference in the static efficiency.

In supplying the air to the generator through the experimental results, it can be seen that when supplying a relatively small flow amount, the structure of the blade 10 of the present disclosure reduces the low-speed region, thus greatly affecting the enhancement of efficiency and performance of the fan.

And, in the region where the volume flow rate is high, it can be seen that there is no significant difference in the pressure drop, such that there is no difference in performance from the conventional blade structure.

That is, in applying the structure of the blade 10 of the present disclosure, it means that since the low-speed region is effectively reduced under the circumstance that the volume flow rate is low compared to the conventional blade structure and performance thereof is maintained under the circumstance that the volume flow rate is high, it is preferable to apply the present disclosure to the suction pipe 40 of the generator.

Meanwhile, the present disclosure can further include the fan having the hub 90 connected to the rotation shaft of the driving device, and the blade 10 located in plural spaced at a predetermined interval along the circumferential direction of the hub 90, and including the blade structure.

Figure 1:
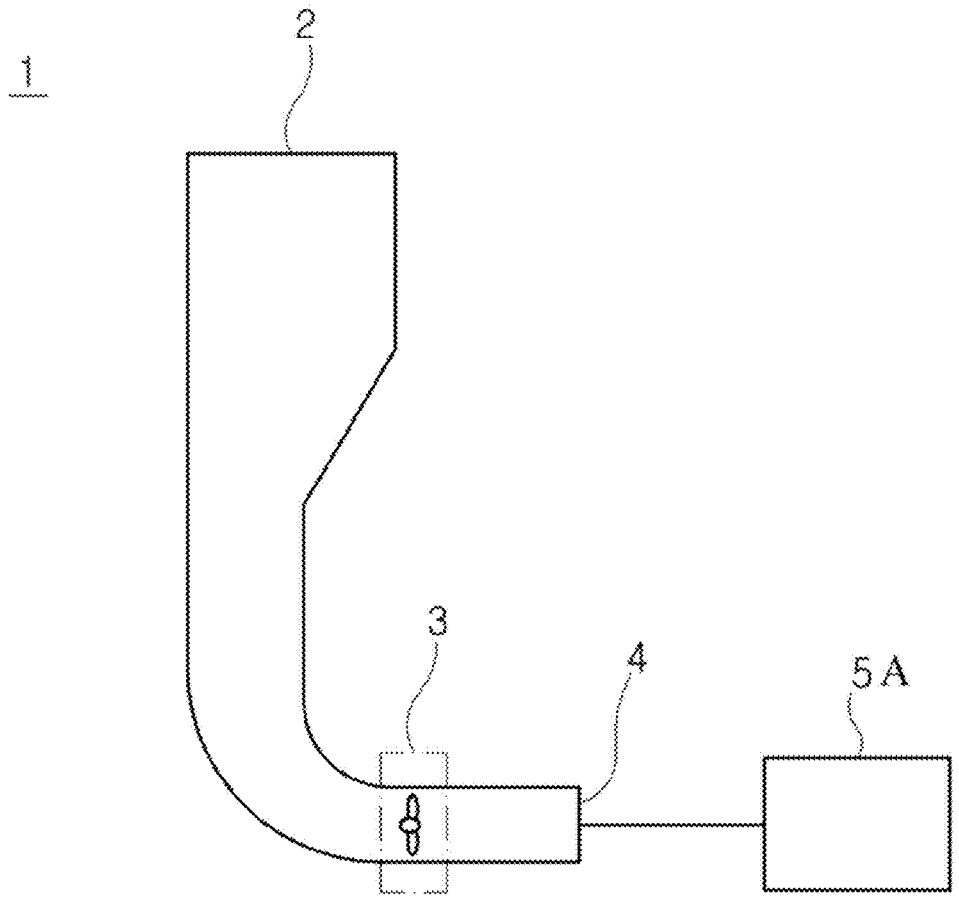
FIG. 1 (RELATED ART)
FIG. 1 is a schematic diagram illustrating an air suction pipe of a generator.

And, the present disclosure can further include the generator 1 (referring to FIG. 1) having the suction pipe 40 into which external fluid is flowed, a power generator 5A (referring to FIG. 1) connected with the suction pipe 40 and producing power using the fluid flowed from the suction pipe 40, and the fan 50 interposed between the suction pipe 40 and the power generator 5A, and sucking the fluid from the suction pipe 40 and delivering it to the power generator 5A.

The above description is only specific embodiments of the blade structure, and the fan and tire generator having the same.

Accordingly, it will be apparent to those skilled in the art that the present disclosure can be substituted and modified in various forms without departing from the spirit of the present disclosure as defined by the following claims.

What is claimed is:

1. A blade structure, comprising:

a plurality of blades spaced at a predetermined interval along a circumferential direction of a hub of a fan, each of the plurality of blades comprising:

a body portion of a blade comprising a root portion connected to the hub and a tip portion forming an outside end portion thereof;

a leading edge portion formed at the inflow direction side of fluid on the body portion;

a trailing edge portion formed at the outflow direction side of fluid on the body portion; and a sweep portion formed in a straight line in profile on at least any one of the leading edge portion or the trailing edge portion in order to reduce a fluid low-speed region at the tip portion compared to the root portion.

2. The blade structure of claim 1, wherein the sweep portion comprises a first sweep portion formed at the leading edge portion of the body portion, and has a forward sweep formed in the inflow direction side of fluid.

3. The blade structure of claim 2, wherein the first sweep portion is formed at the outside portion based on the radial direction of the leading edge portion.

4. The blade structure of claim 2, wherein the leading edge portion is divided into a first leading portion and a second leading portion based on the longitudinal direction thereof, and the first sweep portion is formed on the first leading portion and the second leading portion at different angles.

5. The blade structure of claim 1, wherein the sweep portion comprises a second sweep portion formed at the trailing edge portion of the body portion, and has a forward sweep formed in the inflow direction side of fluid.

6. The blade structure of claim 5, wherein the second sweep portion is formed at the outside portion based on the radial direction of the trailing edge portion.

7. The blade structure of claim 5, wherein the trailing edge portion is divided into a first terminal portion and a second terminal portion based on the longitudinal direction thereof, and the second sweep portion is formed on the first terminal portion and the second terminal portion at different angles.

8. The blade structure of claim 1, wherein the sweep portion comprises a first sweep portion formed at the leading edge portion; and a second sweep portion formed at the trailing edge portion, wherein the first sweep portion and the second sweep portion have a forward sweep formed at different angles.

9. The blade structure of claim 8, wherein an angle of the first sweep portion is more acute than an angle of the second sweep portion.

10. A generator, comprising:

a suction pipe into which external fluid is flowed;

a power generator connected with the suction pipe, and producing power using the fluid flowed from the suction pipe; and a fan interposed between the suction pipe and the power generator, and sucking the fluid from the suction pipe and delivering it to the power generator, wherein the fan comprises a hub connected to a rotation shaft of a driving device; and a plurality of blades spaced at a predetermined interval along the circumferential direction of the hub, and comprising the blade structure of claim 1.

11. A blade structure, comprising:

a plurality of blades spaced at a predetermined interval along a circumferential direction of a hub of a fan, each of the plurality of blades comprising:

a body portion of a blade comprising a root portion connected to the hub and a tip portion forming an outside end portion thereof;

a leading edge portion formed at the inflow direction side of fluid on the body portion;

a trailing edge portion formed at the outflow direction side of fluid on the body portion; and a spline portion formed in a curve on at least any one of the leading edge portion or the trailing edge portion in order to reduce a fluid low-speed region at the tip portion compared to the root portion, wherein the spline portion comprises a first spline portion formed at the leading edge portion of the body portion, and is formed to have a predetermined curvature in the inflow direction side of fluid, and wherein the first spline portion is formed in a 25~100% region based on the root portion of the body portion along the radial direction of the leading edge portion.

12. The blade structure of claim 11, wherein the first spline portion is formed in a 50~100% region based on the root portion of the body portion along the radial direction of the leading edge portion.

13. The blade structure of claim 11, wherein the first spline portion is formed in a 75~100% region based on the root portion of the body portion along the radial direction of the leading edge portion.

14. The blade structure of claim 11, wherein the spline portion comprises a second spline portion formed at the trailing edge portion of the body portion, and is formed to have a predetermined curvature in the inflow direction side of fluid.

15. The blade structure of claim 14, wherein the second spline portion is formed in a 25~100% region based on the root portion of the body portion along the radial direction of the trailing edge portion.

16. The blade structure of claim 14, wherein the second spline portion is formed in a 50~100% region based on the root portion of the body portion along the radial direction of the trailing edge portion.

17. The blade structure of claim 14, wherein the second spline portion is formed in a 75~100% region based on the root portion of the body portion along the radial direction of the trailing edge portion.

18. The blade structure of claim 11, wherein the spline portion comprises a first spline portion formed at the leading edge portion; and a second spline portion formed at the trailing edge portion, wherein the first spline portion and the second spline portion are inclined toward the inflow direction side of fluid at different curvatures.

* * * * *